US009802795B2

(12) United States Patent
Søe et al.

(10) Patent No.: US 9,802,795 B2
(45) Date of Patent: Oct. 31, 2017

(54) CRANE FOR HANDLING OF WIND TURBINE GENERATOR COMPONENTS AND METHOD OF HOISTING OF SUCH A CRANE

(76) Inventors: Jeppe Sartori Søe, Ronde (DK); Jesper Stærke Rosengren, Jelling (DK)

( * ) Notice: Subject to any disclaimer, the term of this patent is extended or adjusted under 35 U.S.C. 154(b) by 536 days.

(21) Appl. No.: 13/643,786

(22) PCT Filed: Apr. 29, 2011

(86) PCT No.: PCT/DK2011/050141

§ 371 (c)(1),
(2), (4) Date: Jan. 7, 2013

(87) PCT Pub. No.: WO2011/134477

PCT Pub. Date: Nov. 3, 2011

(65) Prior Publication Data

US 2013/0098859 A1 Apr. 25, 2013

(30) Foreign Application Priority Data

Apr. 29, 2010 (DK) ..... 2010 70178

(51) Int. Cl.
*B66C 23/18* (2006.01)
*B66C 23/20* (2006.01)

(52) U.S. Cl.
CPC ..... *B66C 23/185* (2013.01); *B66C 23/207* (2013.01)

(58) Field of Classification Search
CPC ..... B66C 23/207; B66C 23/18; B66C 23/185; B66C 23/20; B66C 23/203; B66C 23/208;
(Continued)

(56) References Cited

U.S. PATENT DOCUMENTS 5,056,673 A * 10/1991 Williams ..... B66C 23/203 212/179
8,939,299 B2 * 1/2015 Ahler ..... B66C 23/207 212/270

(Continued)

FOREIGN PATENT DOCUMENTS

DE 19647515 A1 * 5/1998 ..... B66C 23/207
DE 19741988 A1 4/1999

(Continued)

OTHER PUBLICATIONS

English translation of DE 19647515 A1.*

(Continued)

*Primary Examiner* — Sang K Kim
*Assistant Examiner* — Nathaniel L Adams
(74) *Attorney, Agent, or Firm* — Wood Herron & Evans LLP

(57) ABSTRACT

A crane capable of handling major components during installation or servicing of wind turbines includes a main body on which is mounted a crane arm, and a lifting point at or near an upper end of the main body to which a hoisting cable assembly is joined or around which a lifting cable is passed and which carries a major part of the crane weight as it is hoisted up a tower of the wind turbine, wherein the lifting point is laterally adjustable relative to the main body in a direction which is generally towards or away from the tower when in its lifting orientation in order to allow control of the crane balance.

14 Claims, 6 Drawing Sheets

(58) Field of Classification Search
CPC ..... B66C 23/24; B66C 23/28; B66B 19/00; B66B 19/04; B66B 9/187; B66B 9/16; E04H 12/00; E04H 12/34; E04H 12/342
See application file for complete search history.

(56) References Cited

U.S. PATENT DOCUMENTS

| | | | | |
|---|---|---|---|---|
| 2007/0200103 | A1* | 8/2007 | Viladomiu I Guarro et al. | 254/334 |
| 2009/0084747 | A1 | 4/2009 | Heinaman | |
| 2009/0159549 | A1 | 6/2009 | Trede | |
| 2010/0101086 | A1* | 4/2010 | Amram | B66C 23/207 29/889.1 |
| 2013/0223964 | A1* | 8/2013 | Zheng | E04H 12/34 414/560 |

FOREIGN PATENT DOCUMENTS

| | | | |
|---|---|---|---|
| DE | 10222472 | A1 | 12/2003 |
| WO | 2004088133 | A1 | 10/2004 |
| WO | 2008059118 | A1 | 5/2008 |
| WO | 2009080047 | A2 | 7/2009 |

OTHER PUBLICATIONS

International Searching Authority, International Search Report issued in corresponding PCT/DK2011/050141 dated Aug. 2, 2011, 12 pages.
Danish Patent and Trademark Office, Search Report issued in corresponding DK Patent Application No. PA 201070178 dated Dec. 22, 2010, 4 pages.

* cited by examiner

CRANE FOR HANDLING OF WIND TURBINE GENERATOR COMPONENTS AND METHOD OF HOISTING OF SUCH A CRANE

FIELD OF THE INVENTION

The invention relates to a crane for use in handling of components of a wind turbine generator during erection and servicing, and to a method of hoisting of such a crane.

BACKGROUND OF THE INVENTION

Wind turbine generators (hereinafter 'wind turbines') of commercial mega-watt scale comprise a rotor which is mounted for rotation atop a tall tower on a main shaft held on a nacelle. The nacelle also houses the main operative components including a gearbox, if provided, and generator, converter etc. In the erection of wind turbines it is necessary to lift the various components of the turbine, including tower sections themselves as the tower is erected, and the various operative components. As the size of wind turbines grows ever larger these components become larger and heavier, and more challenging to erect and service.

Commonly, stand-alone service cranes are used for the lifting of major components on turbine erection. These have the disadvantage of needing to be significantly taller then the tower, and require significant time to erect and dismantle, needing a large amount of transportation equipment, and may suffer problems of access in difficult to reach places, with the result that they are an expensive and somewhat inflexible solution.

The turbine typically also has an internal crane within the nacelle which is suitable for the lifting of relatively small components. Such cranes are not however of sufficient capacity, dimension or positioning to be able to handle major components including turbine blades or gearboxes or main bearings.

It has been proposed to provide dedicated cranes which can be hoisted up the tower (or in certain versions can self-climb up) to an appropriate position on the tower for the task in hand, or up to the position of the nacelle, and which is secured to the tower and/or nacelle in a working position where it is able to handle major turbine component installation, replacement and repair.

In Applicant's WO2009/080047 the contents of which are hereby incorporated by reference there is disclosed a dedicated crane having a main body from which extends a work platform, with a pair of gripping arms which serve to clamp tightly around the tower when in the working position. The crane is hoisted through the use of an intermediate pulley assembly, whereby the small capacity internal nacelle crane is used to hoist this intermediate pulley assembly up to the nacelle, and this intermediate pulley assembly then used to hoist the crane body, with hoist motors on the crane, or on the ground or on a transporting truck, providing the drive for the hoisting operation. The crane is carried to the site on a truck and hoisted from the truck, with a guiding cable secured to the crane and being played out from a drum on the truck as the crane is hoisted, serving to guide the crane and prevent undue swinging of the crane which might otherwise cause damage to the crane and tower.

The hoisting of the crane to the nacelle involves particular challenges. Firstly, lifting the crane off the truck or other mode of transport from which it has been transported to the site presents a challenge as, depending on its design, the crane is typically transported in a horizontal orientation and must be raised to its vertical upright orientation before hoisting. This change in orientation requires care as the crane is in general designed for handling in its vertical working orientation. Moreover, hoisting of the crane up the tower involves a large vertical distance of travel (current generation towers for large wind turbine models may be 80 to 120 m in height and are growing as the drive for ever-larger turbines continues). Towers are typically slightly conical showing a significant reduction in diameter up the tower. Finally, as the crane approaches the nacelle the direction from which the tension on the lifting point arises changes quite significantly, with implications for the balance and stability. Controlling the hoisting of the crane is of the upmost importance in order that the crane may be safely raised without damage to crane, tower or risk of danger to personnel, and this may be in weather conditions which are less than ideal The present invention seeks to provide a crane structure which facilitates safe lifting.

SUMMARY OF THE INVENTION

According to the present invention there is provided a crane for use in handling of components during installation or servicing of wind turbines, comprising: a main body, a crane arm mounted on the main body, and a lifting point at or near an upper end of the main body to which a hoisting cable assembly is joined or around which a lifting cable is passed and which carries a major part of the crane weight as it is hoisted, wherein the lifting point is laterally adjustable relative to the main body.

The ability to adjust the lifting point allows the crane to be appropriately balanced as it is being hoisted, and as well as addressing the particular difficulties of handling the crane on the ground, including in its horizontal orientation in which it is typically transported. It should be noted that in the tower of a modern wind turbine, the tower diameter typically exhibits considerable variation from bottom to top, for example a base region may be of 3.5-5.5 m diameter whereas immediately beneath the nacelle it my be of about 2-3.5 m diameter. This variation means that a crane which is balanced at a tower base will not be balanced at a higher position, but will be exerting a torque on the tower In the preferred arrangement, the lifting point is provided at or near an end of the main body which is uppermost in its working orientation. The lifting point comprises a pulley or block through which the hoisting cable passes or is connected. From the lifting point the cable preferably passes onto a powered winding drum onto which the cable is wound, whereby the crane is self-hoisted as cable is wound on to the drum.

In one form the crane main body is provided with an elongate main body having an attachment interface at its lower end for attachment to a tower of the wind turbine, and may have, at or near its upper end, a tower-engaging wheel or roller which bears against the tower as it is being hoisted.

In a further aspect the invention resides in a method of hoisting the crane as described above, which method comprising the step of adjusting the position of the lifting point as the crane is hoisted in order to control its balance.

In a still further aspect the invention resides in a method of hoisting a crane for use in installation or servicing of components of a wind turbine, the crane comprising a main body having an end which in use on the tower is an upper end, a crane arm mounted on the main body, and a lifting point or points at or near an upper end of the main body to which a hoisting cable assembly is joined or around which it passes, an upper end of the hoisting cable assembly extending to the nacelle or an upper region of the tower, and the lifting point or points being laterally adjustable relative to the main body, the method including adjusting the position of the lifting point or points as the crane is hoisted to control the crane balance.

Prior to hoisting the crane up the tower the crane is preferably lifted from a truck or waterborne vessel on which it has been transported in a horizontal orientation, the method comprising the steps of securing the hoisting cable assembly to the crane to extend between an upper point on the nacelle or a point at or near the top of the tower, and the lifting point or points on the crane, conducting an initial lifting operation of the crane with the hoisting assembly so that the crane pivots about its lower end on the truck or vessel into a substantially upright orientation, and further hoisting the crane up the tower into an operating position on the tower. Prior to conducting this initial lifting operation the position of the lifting point is adjusted so that it is displaced in a direction which is generally upwards when the crane is in its horizontal transport orientation. The lifting point is then displaced as the crane approaches its upright orientation in order to maintain the lifting point generally over the centre of gravity.

The lifting point is further displaced as the crane approaches the top of the tower, preferably in a direction towards the tower as the crane approaches the top of the tower, in order to accommodate the change in direction of tension as the crane approaches the nacelle.

BRIEF DESCRIPTION OF THE DRAWINGS

Embodiments of the invention are described, by way of example only, with reference to the following drawings in which.

DETAILED DESCRIPTION OF THE PREFERRED EMBODIMENTS

The invention relates to a dedicated crane for hoisting up a wind turbine tower for use in particular in effecting installation, replacement or repair of major wind turbine components.

Figure 1:
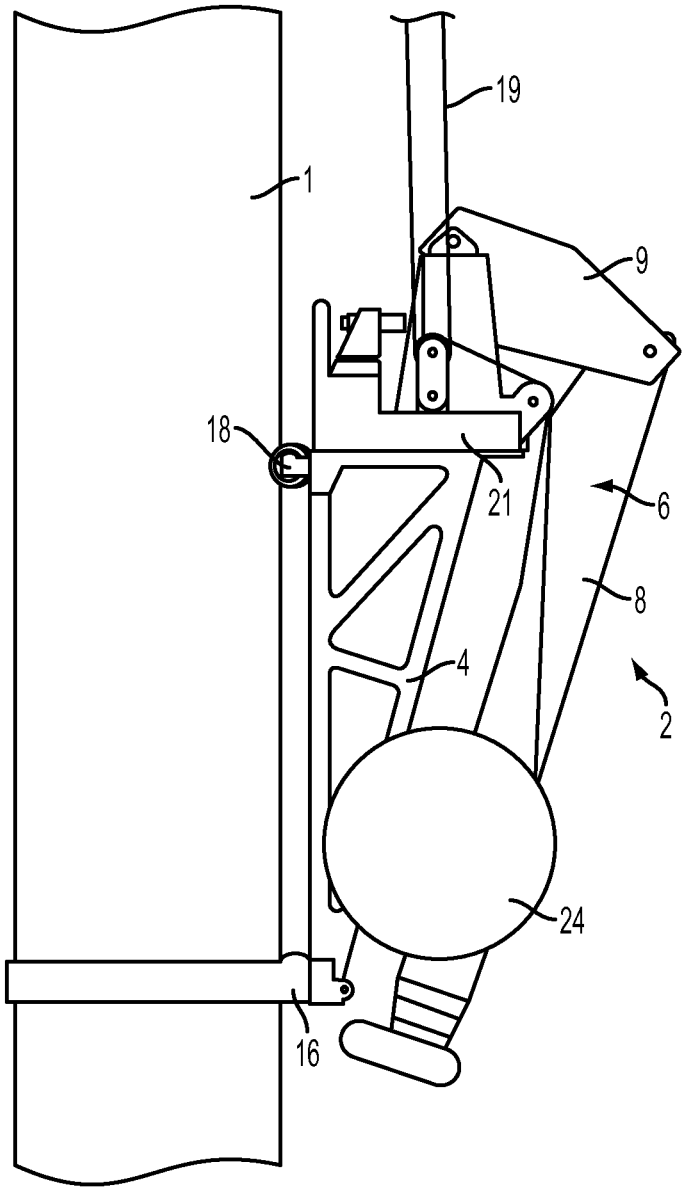
FIG. 1 shows a tower crane in accordance with a first embodiment of the invention as it is being hoisted up the tower.
Figure 2:
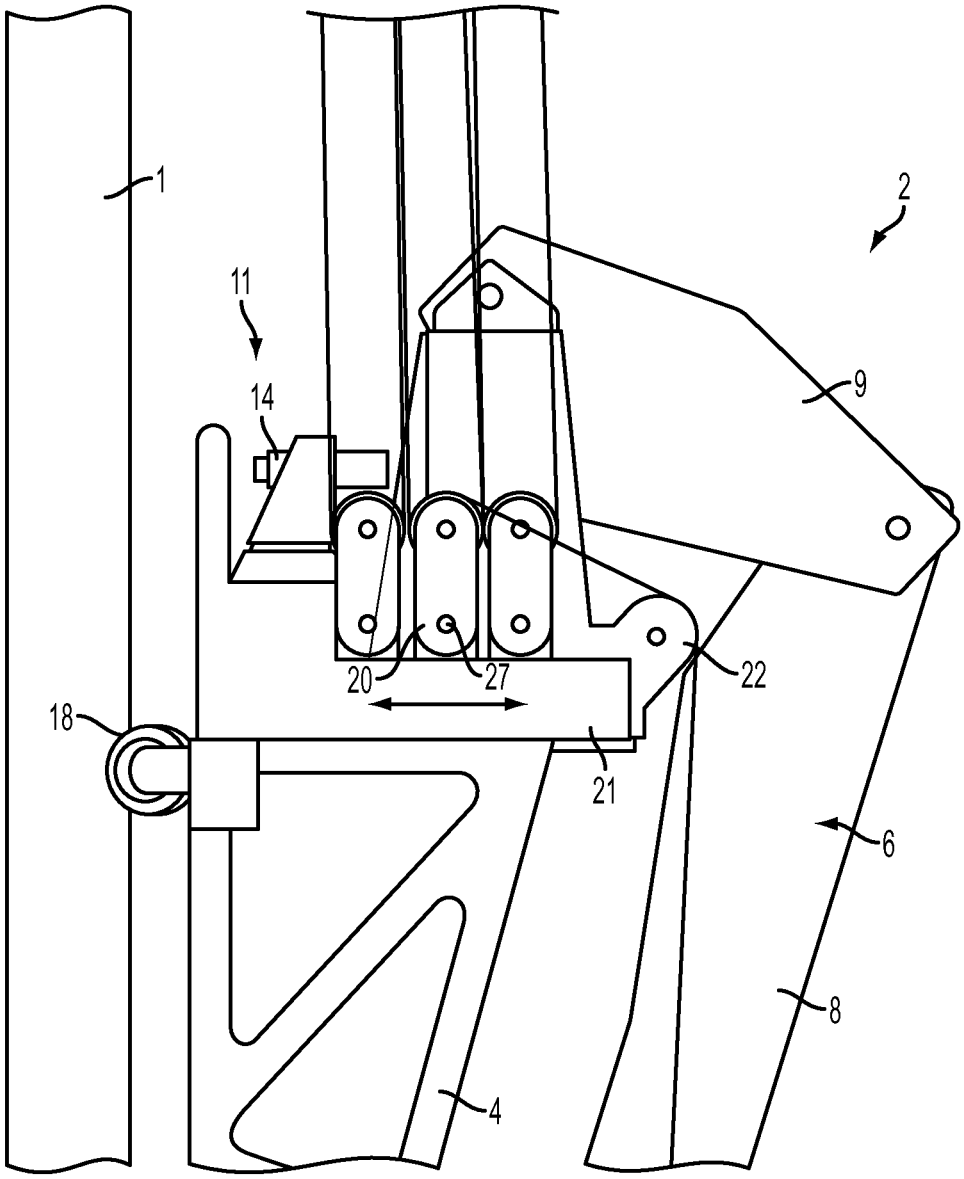
FIG. 2 is an enlarged view of the upper region of the tower crane showing the adjustable lifting point as moved between positions.

As illustrated in FIGS. 1 and 2 there is shown up against a tower 1 of a wind turbine a crane generally indicated 2, comprising a main body 4, which is in the form of a generally elongate frame-like structure. At a position at or near its upper end the crane main body 4 carries a movable crane arm 6. This is mounted on a turntable-like assembly in a manner whereby the arm 6 can pivot in its entirety about a vertical axis. As illustrated, the crane arm 6 comprises a number of individual arm sections pivotably connected through parallel horizontal axes, including a main jib section 8 and one or more base sections 9. In FIG. 1 the arm 6 is shown in folded or retracted position in which it is arranged during transport, hoisting and lowering in which the main jib section 8 lies closely against the main body 4. Although not illustrated, the crane arm 6 may be constituted by a number of individual telescoping arm sections whereby the arm can be extended or retracted as desired to adjust its working reach. The end of the crane arm may carry a pulley or block of pulleys over which is led a lifting cable.

At its upper end the crane carries an attachment interface whereby it can be secured to a part of a nacelle once it has been hoisted to its operating position. This may take a variety of forms, but as illustrated comprises a docking structure 11 and an associated locking arrangement including a movable locking pin 14.

At its lower end the crane 2 is constrained through an attachment interface which provides a connection to the tower 1. As illustrated this comprises a flexible band 16 which encircles the tower. This is fitted around the tower 1 as the crane 2 is first positioned up against the base of the tower 1. This band 16 provides a relatively loose horizontal constraint for the lower region of the crane 2 as it is hoisted up the tower 1. Once the crane is in its working position up the tower the band 16 can be tensioned to provide a tight connection.

As an alternative, the interface of the crane main body 4 with the tower comprises gripping means for gripping the tower in the form of a pair of flexible tensionable bands which encircle the tower, as described in detail in Applicant's co-pending patent application of even date. Alternatively, the gripping means may be in the form of gripping arms such as hydraulically operated clamp arms, as described in detail in Applicant's WO2009/080047 and as shown schematically in FIG. 6. It will be appreciated that a variety of other means of securing the crane to the tower may alternatively or additionally be utilised, such as bolts or brackets, magnets or other fixings to the tower or nacelle.

An upper region of the crane is provided with one or more tower-abutting wheels or rollers 18 whereby an upper region of the crane can roll up the tower surface as it is hoisted, avoiding possible damage to the tower surface which might result from a non-rolling point of abutment.

The crane is hoisted and supported vertically through a cable connection. More particularly, a cable or cable assembly 19 extends from the nacelle or a component directly connected thereto to lifting points on the crane 2 which are each in the form of a pulley or block 20, from where the cable or cables are led via appropriately-positioned guide blocks 22 to a hoisting drum 24. Hoisting drum 24 is a motor-driven cable-winding drum; as the motor winds or unwinds cable this thereby raises or lowers the crane up or down the tower. Although only a single lifting point is visible in FIGS. 1 and 2 it will be appreciated that identical structures are provided on opposite sides of the crane.

In accordance with the invention the crane lifting points are laterally adjustable on the crane towards or away from the tower. As shown most clearly in FIGS. 2 and 3, in the illustrated embodiment the block 20 constituting the lifting point is arranged at an upper platform structure of the crane body within a guide 21. More particularly, the block 20 is secured to a driven link which is largely constrained within the guide 21 but which has an upstand which protrudes through an upwardly-facing (in the working orientation) slot 26, the block being secured to this upstand in a manner whereby it can pivot about point 27, whereby the block can follow the direction of cable tension. The driven link is driven to move within the guide 21 and slot by an internal drive motor and appropriate mechanical linkage such as a worm/screw or hydraulic cylinder or other appropriate structure, whereby the block can be adjusted in the lateral direction which is towards or away form the tower when in the lifting orientation.

During hoisting up the tower, adjustment of the lifting point allows adjustment of the balance of the suspended crane to be effected. In general, adjustment is carried out so that the lifting point remains vertically aligned with the centre of mass of the crane 2. As such there is no or very limited torque exerted on the tower 1 by the crane's points of contact during hoisting or in the working position. Note that this adjustment is able to accommodate changes in balance arising from the change in tower diameter up the tower. FIG. 2 shows the block 20 in a central position along the guide 21.

Figure 3:
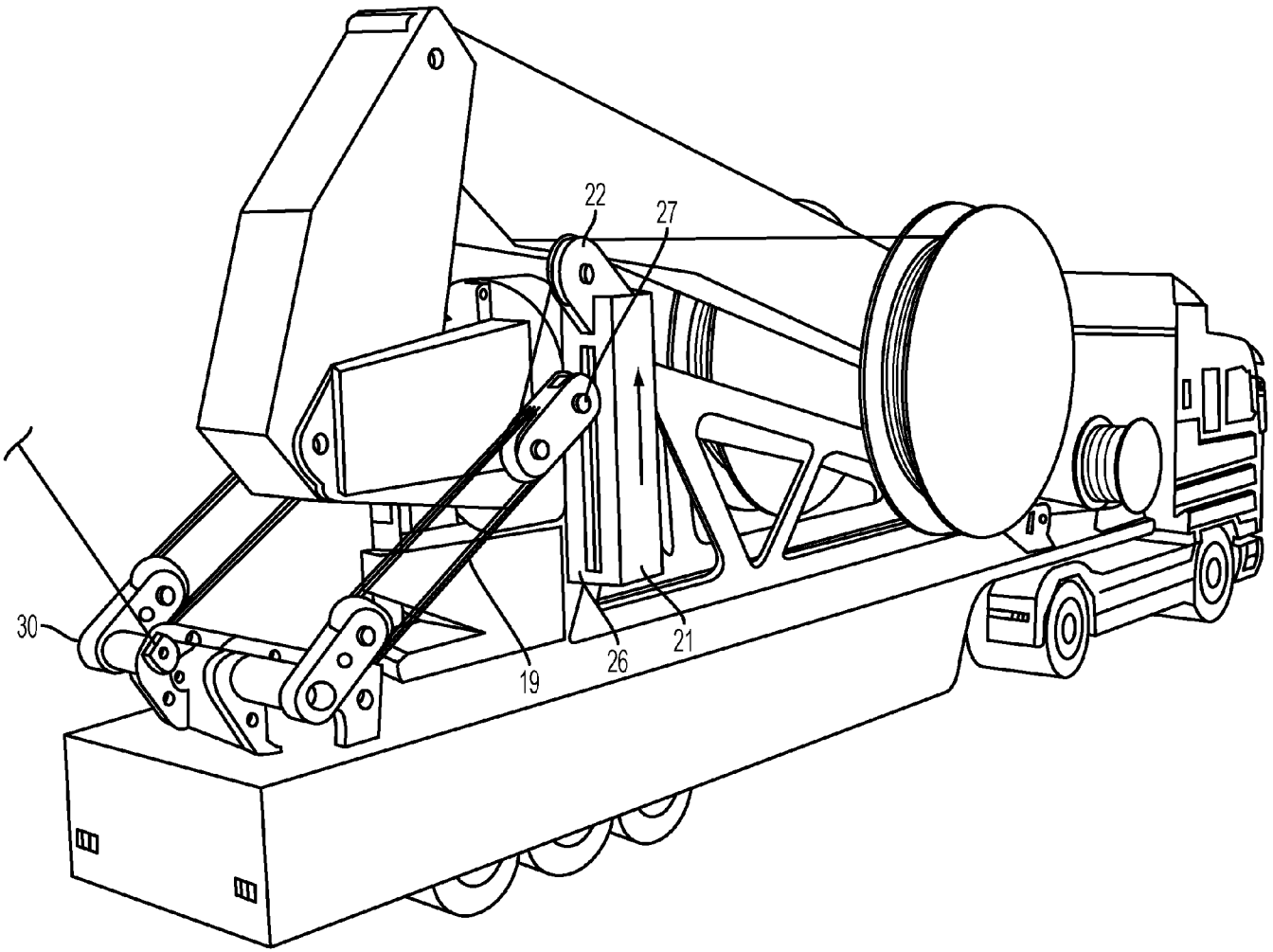
FIG. 3 shows the crane as it is being transported to the site on a truck.
Figure 4:
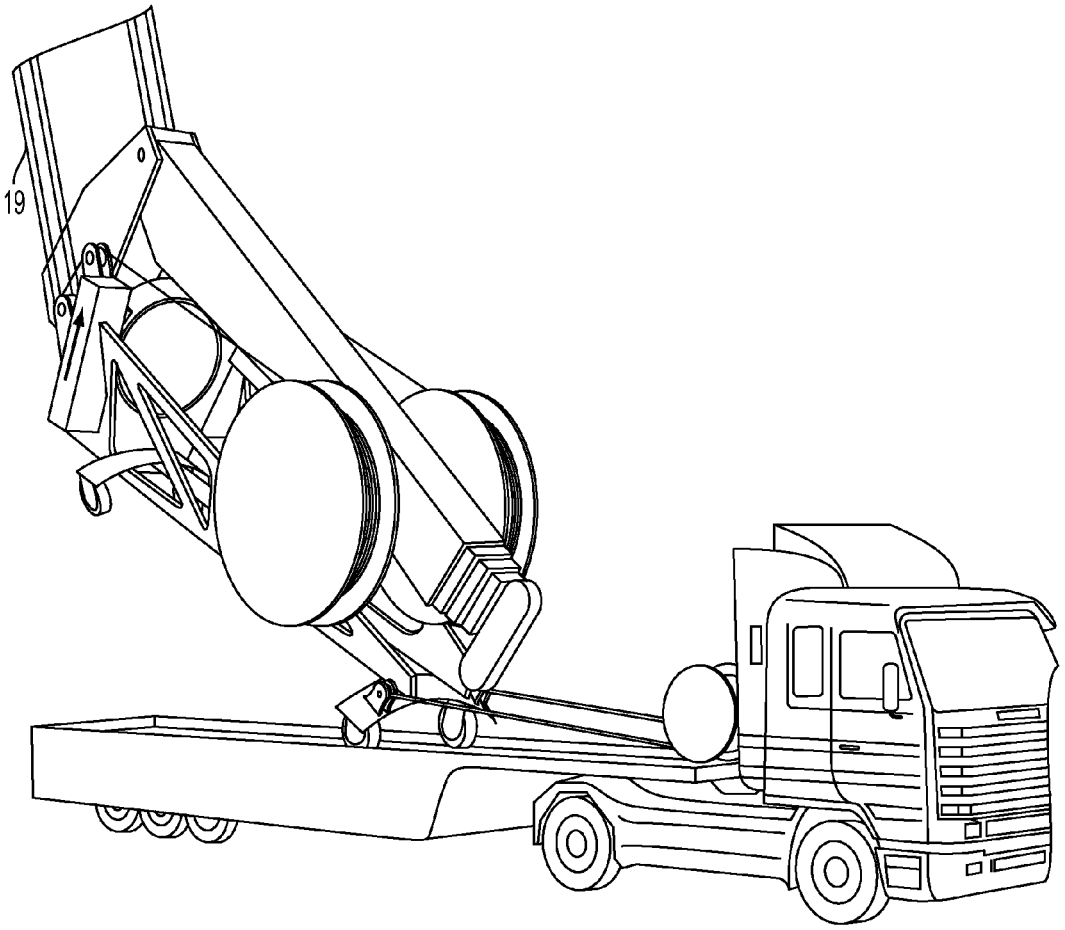
FIG. 4 shows the crane as it is being lifted off the truck.

This lateral adjustment is also advantageous as the cane is being handled at the ground, and on hoisting as it approaches the nacelle. As illustrated in FIG. 3, the crane will typically be transported to the turbine on a truck (or in the case of an offshore turbine, on the deck of a vessel such as a ship or barge). As the truck (or vessel) arrives at the wind turbine tower it is maneuvered into position closely adjacent the tower base. A cable or wire connection is then established between the crane 2 and the nacelle. In the preferred technique, in accordance with the principles adopted in Applicant's WO2009/080047 the internal nacelle crane is used to hoist the larger capacity intermediate hoisting assembly indicated 30 shown here in its transport position on the rear of the truck, which is in turn used to hoist the crane. The intermediate hoisting assembly 30 carries the cable assembly which is connected to the crane through its main lifting point 20. Thus, a cable is lowered from the internal nacelle crane and connected to the intermediate hoisting assembly 30, which is hoisted by the internal crane and when in position secured to the nacelle and/or tower. The crane 2 is then able to be hoisted using this intermediate hoisting assembly 30 with the main drive provided by the crane motorized drum 24. As shown in FIG. 4 the initial lifting causes the upper end of the crane to lift so that it pivots on the truck about its lower end, about a pair of wheels located at the crane lower end for this purpose. At this time it is arranged that the lifting block 20 is adjusted so that it is located at its position which is distant from the (in use) tower—facing side of the crane 2, i.e. the uppermost position along its slot in FIG. 3 (or rightmost position as illustrated in FIG. 2). This ensures that the lifting point is well above the crane centre of gravity. FIG. 4 shows the crane as it is part way through its pivoting towards the upright orientation. Control lines are connected between a drum on the truck and a lower region of the crane and are progressively played out to maintain a degree of tension therein, serving to constrain the crane against excessive movement, which might otherwise risk damage to crane or tower. Once in or near the upright orientation the lift point can be moved closer to the tower-facing side, adopting an approximately central position, and with relatively smaller adjustments effected to ensure a fine balancing prior to hoisting, and during hoisting.

Figure 5:
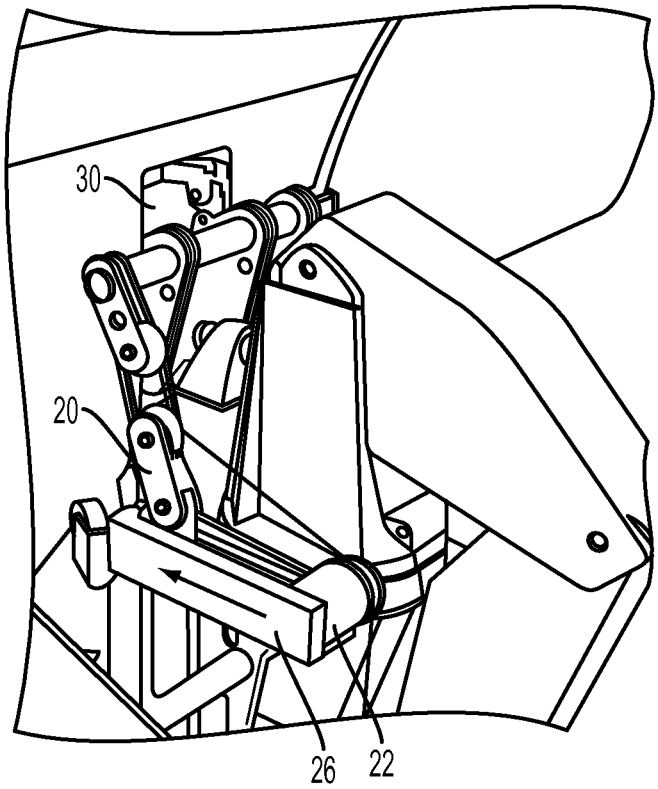
FIG. 5 shows the crane in position at the top of the tower, adjacent the nacelle.

As the crane is hoisted to a position close to the nacelle further adjustment may be needed, depending on the precise position of the point at which the hoist cable is disposed. FIG. 5 shows the intermediate hoist assembly 30 having been hoisted so that the cable support point thereof lies close to the nacelle cover. In order to allow the crane to be lifted tightly against the intermediate hoist assembly 30 the block 20 of the crane lifting point is adjusted inwardly towards the tower, FIG. 5 showing the block in its innermost position It will be seen that the block also pivots about point 27 to face the direction of tension.

Figure 6:
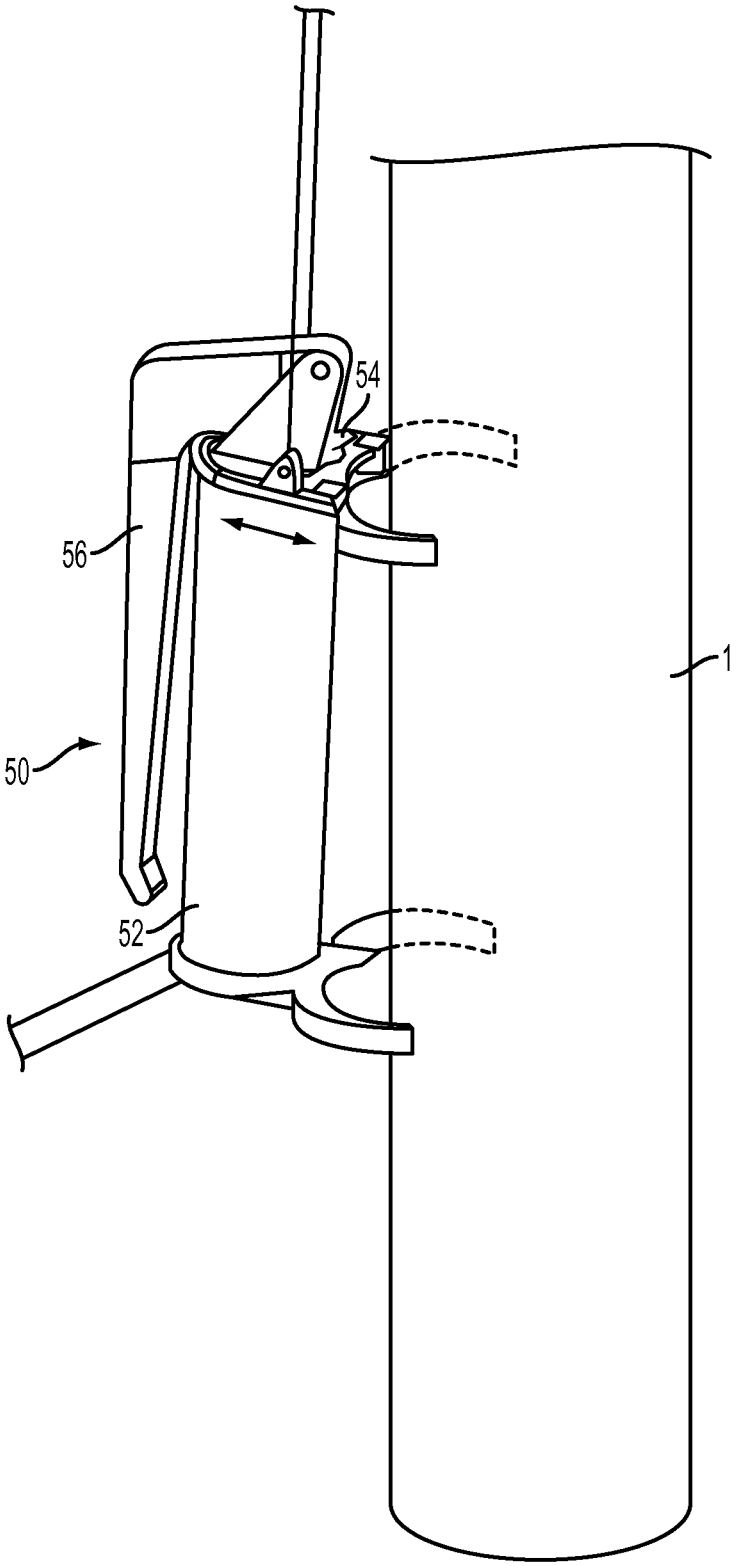
FIG. 6 shows an alternative structure of crane being hoisted up a tower.

FIG. 6 shows a tower crane 50 of alternative form where instead of a frame-like main body, the main body has an elongate hollow tubular form, as is described further in Applicant's co-pending application of even date. More particularly, the main body 52 comprises a hollow shell construction of circular section. An upper region of the main body 52 supports a flange-like platform 54 on which is arranged a pivotable turntable which carries the crane arm 56. This platform 54 also carries the lifting point 58 utilizing a similar structure to the above-described embodiment of block which is slidable within a guide, and which in similar manner is laterally adjustable towards or away from the tower. This form of crane is intended to be transported in an orientation whereby its arm (in its folded orientation) is face down. On lifting, the lift point is thus moved towards the side of the crane which is away from the arm, so that the lift point is maintained well above the centre of gravity.

The use of the adjustable lift point is equally applicable to crane configurations where there is no change in the general orientation of the crane as between the transporting truck or vessel, and its operative orientation, for example as illustrated in Applicant's WO2009/080047. The adjustment of the lift point allows the horizontal forces on the tower to be controlled during hoisting, and allowing control of the cable angles especially as the crane approaches the top the tower where the angle of the cable relative to the crane changes.

While the invention has been particularly shown and described with reference to the preferred embodiments thereof it will be understood by those skilled in the art that the foregoing and other changes in form and detail may be made without departing from the scope of the invention.

The invention claimed is:

1. A crane for use in handling of components during installation or servicing of a wind turbine, the wind turbine including a tower and a nacelle at a top of the tower, the crane comprising:

a main body configured to be movably mounted to the wind turbine tower;

a tower-engaging element coupled to the main body and configured to bear against the tower when the main body is mounted to the tower;

a crane arm mounted on the main body and movable relative to the main body;

a lifting point adjacent an upper end of the main body, the lifting point being laterally adjustable relative to the tower-engaging element;

at least one hoisting cable operatively coupled to the wind turbine adjacent an upper end of the wind turbine and further operatively coupled to the lifting point of the crane for hoisting the crane along the wind turbine tower; and a drive configured to effect lateral adjustment of the lifting point relative to the tower-engaging element, wherein the lifting point is laterally adjustable independent of the position of the main body along the tower and independent of movement of the crane arm during use.

2. The crane according to claim 1 wherein the lifting point comprises a pulley or block of pulleys operatively coupled to the at least one hoisting cable.

3. The crane according to claim 2 further comprising a powered winding drum onto which the at least one hoisting cable is wound after passing through the pulley or block of pulleys of the lifting point, whereby the crane is self-hoisted as the at least one hoisting cable is wound on to the drum.

4. The crane according to claim 1 wherein the main body is provided with an elongate main body having an attachment interface at its lower end for attachment to a tower of the wind turbine.

5. The crane according to claim 1 wherein the crane is provided with a tower-engaging wheel or roller which bears against the tower as the crane is being hoisted.

6. A method of hoisting a crane, the method comprising providing the crane according to claim 1; and adjusting the position of the lifting point as the crane is hoisted in order to control its balance.

7. The crane according to claim 1, wherein the main body and the tower-engaging element are not laterally adjustable relative to each other.

8. The crane according to claim 1, wherein the lifting point is on the main body.

9. A method of hoisting a crane for use in installation or servicing of components of a wind turbine, comprising:

providing a crane having a main body, a tower-engaging element coupled to the main body, a crane arm mounted on the main body and movable relative to the main body, a lifting point adjacent an upper end of the main body, the lifting point being laterally adjustable relative to the tower-engaging portion, at least one hoisting cable coupled to the lifting point of the crane, and a drive configured to effect lateral adjustment of the lifting point relative to the tower-engaging element, wherein the lifting point is laterally adjustable independent of the position of the main body along the tower and independent of movement of the crane arm during use;

mounting the crane to a tower of the wind turbine;

coupling the at least one hoisting cable to a nacelle of the wind turbine or an upper region of the tower;

hoisting the crane up the tower; and adjusting the position of the lifting point as the crane is hoisted to control the crane balance.

10. The method according to claim 9 wherein prior to hoisting the crane up the tower the crane is lifted from a truck or waterborne vessel on which it has been transported in a horizontal orientation, the method comprising the steps of:

securing the hoisting cable assembly to the crane to extend between an upper point on the nacelle or a point at or near the top of the tower, and the lifting point or points on the crane;

conducting an initial lifting operation of the crane with the hoisting assembly so that the crane pivots about its lower end on the truck or vessel into a substantially upright orientation; and further hoisting the crane up the tower into an operating position on the tower.

11. The method according to claim 10 wherein prior to conducting the initial lifting operation the position of the lifting point is adjusted so that it is displaced in a direction which is generally upwards when the crane is in its horizontal transport orientation.

12. The method according to claim 11 wherein the lifting point is displaced as the crane approaches its upright orientation in order to maintain the lifting point generally over the centre of gravity.

13. The method according to claim 9 wherein the lifting point is further displaced as the crane approaches the top of the tower.

14. The method according to claim 13 wherein the lifting point is displaced laterally towards the tower as the crane approaches the top of the tower.

* * * * *